US005775122A

United States Patent [19]

Waase

[11] Patent Number: 5,775,122

[45] Date of Patent: Jul. 7, 1998

[54] METHOD OF AND APPARATUS FOR COOLING HOT-ROLLED STRUCTURAL SHAPES

[75] Inventor: Dieter Waase, Kaarst, Germany

[73] Assignee: SMS Schloemann-Siemag AG, Dusseldorf, Germany

[21] Appl. No.: 813,762

[22] Filed: Mar. 7, 1997

[30] Foreign Application Priority Data

Mar. 8, 1996 [DE] Germany ..... 196 08 965.4

[51] Int. Cl.[6] ..... F25D 17/02

[52] U.S. Cl. ..... 62/373; 62/64; 165/134.1; 432/77

[58] Field of Search ..... 62/64, 373; 165/134.1; 432/77

[56] References Cited

U.S. PATENT DOCUMENTS

| | | | |
|---|---|---|---|
| 3,659,428 | 5/1972 | Kunioka et al. | 62/64 |
| 4,065,252 | 12/1977 | Hemsath et al. | 62/64 |
| 4,273,744 | 6/1981 | Krueger | 165/134.1 |

FOREIGN PATENT DOCUMENTS

| | | | |
|---|---|---|---|
| 896 219 A | 9/1983 | Belgium . | |
| 2 455 255 | 11/1980 | France . | |
| 20 40 610 | 6/1971 | Germany . | |
| 21 48 722 | 5/1972 | Germany . | |
| 21 65 049 | 7/1972 | Germany . | |
| 27 02 143 | 7/1977 | Germany . | |
| 27 51 013 | 5/1979 | Germany . | |
| 29 51 818 | 7/1980 | Germany . | |
| 44 30 856 | 3/1996 | Germany . | |
| 623674 | 5/1949 | United Kingdom | 62/64 |
| WO 92/19395 | 11/1992 | WIPO . | |

*Primary Examiner*—Ronald C. Capossela
*Attorney, Agent, or Firm*—Herbert Dubno

[57] ABSTRACT

Method and apparatus for cooling hot-rolled structural shapes in which the hot-rolled structural shape is subjected to at least one energy-rich stream of an aerosol of a liquid in air to cool down the structural shape significantly most rapidly than can be achieved with forced air or a static air cooling.

5 Claims, 4 Drawing Sheets

METHOD OF AND APPARATUS FOR COOLING HOT-ROLLED STRUCTURAL SHAPES

FIELD OF THE INVENTION

My present invention relates to a method of and to an apparatus for the cooling of hot-rolled profiles or structural shapes utilizing a cooling medium and to an improved cooling medium for cooling such structural shapes.

BACKGROUND OF THE INVENTION

Hot-rolled metal products, referred to as structural shapes or profiles, are generally composed of steel and can have a cross section depending upon the rolling line properties. They include bars, billets, rods, angles, I beams, T beams, H beams, channels and other shapes of a wide variety of regular or irregular of cross sections and dimensions. In the hot-rolling of structural steel, the ingot, billet, slab or bloom, at a rolling temperature or heated to a rolling temperature, is reshaped and sized to the structural shape desired by one or more rolling operations and must be cooled from the rolling temperature to ambient temperature or some other lower temperature. In the past, this cooling could be carried out on a so-called cooling bed with stationary air. For more rapid cooling, forced air is generated to provide an energy-rich flow utilizing blowers or the like. Depending upon the mass or structure of the rolled products to be cooled, the speed of the cooling air streams, the temperatures of the products and the air and/or the moisture content of the air, the cooling of the products can be carried out with a gradient of temperature reduction of the products to be cooled which is three times greater with the forced air than with the stationary air.

However, since the heat-transfer coefficient for cooling and stationary air forced air between the rolled product and the air is comparatively small, for a given temperature reduction, a comparatively large amount of air must contact the rolled product. In the case of a cooling bed, this has as a consequence the fact that the cooling bed must be very long and wide so that the capital and operating costs are high and the transport requirements for the rolled products are considerable. In the case of forced cooling, since the cooling is more intensive, the size of the bed can be reduced, although there is a considerable added cost for the blowers that are required and the energy cost for operating the blowers. A problem with such systems is that the energy efficiency is usually low, partly because the thermal efficiency of cooling is low.

OBJECTS OF THE INVENTION

It is, therefore, the principal object of the present invention to provide an improved method of cooling hot rolled structural shapes whereby the aforementioned drawbacks are overcome and the cooling can be carried out with reduced capital and operating costs and greater energy and thermal efficiency.

Another object of the invention is to provide a cooling apparatus for hot-rolled structural sheets which can be operated with considerable economy over earlier systems and has only limited capital cost requirements.

It is also an object of the invention to provide a more economical method of and apparatus for the cooling of structural shapes.

It is also an object of the invention to provide an improved cooling medium for hot-rolled structural shapes.

SUMMARY OF THE INVENTION

These objects are attained, in accordance with the invention by cooling hot-rolled structural shapes utilizing, as a cooling medium, air in which a liquid capable of wetting the surfaces of the structural shape is incorporated in the form of an aerosol homogeneously dispersed in the cooling air.

Thus a method of cooling a hot-rolled structural shape, e.g. of steel, can comprise the steps of:

(a) homogeneously dispersing in air serving as a cooling medium a liquid capable of wetting surfaces of a hot-rolled structural shape to form very fine droplets of the liquid in the air to constitute an aerosol; and (b) contacting the hot-rolled structural shape at an elevated temperature resulting from hot rolling with the aerosol to cool the structural shape.

The apparatus for cooling hot-rolled structural shapes comprises:

means connected to a source of compressed air and a source of a liquid for homogeneously dispersing liquid from the liquid source in air serving as a cooling medium to form very fine droplets of the liquid in the air to constitute an aerosol; and means for directing at least one high-energy stream of the aerosol against a hot-rolled structural shape at an elevated temperature resulting from hot rolling to cool the structural shape.

Of course the improved coolant for use in the apparatus and the method consists predominantly of air containing a liquid, preferably water, in a homogeneous dispersion in the air to form an aerosol thereof. Because of the use of an aerosol as the coolant, the heat-transfer coefficient between the flowing cooling medium and the surface of the rolled product to be cooled and thus the gradient for temperature reduction of the rolled product is significantly improved.

According to the invention, a corrosion-blocking additive can be fed to the liquid prior to dispersing the liquid in the air to form an aerosol. The aerosol is preferably blown onto the structural shape in a directed energy-rich stream, i.e. a high kinetic energy flow.

The structural shape can be cooled uniformly by directing a plurality of angularly equispaced stream of the aerosol centrally at the structural shape, i.e. toward the axis thereof. The structural shape can be displaced along a path during the cooling thereof and streams of the aerosol can be directed against the structural shape at spaced locations along the path. The means for homogeneously dispersing the liquid in the air can include:

a flow-accelerating nozzle having an upstream end and a downstream end, the downstream end discharging the high-energy stream of the aerosol;

a throttle valve connecting the source of compressed air with the upstream end; and a fitting on the nozzle connected to the liquid source.

The nozzle can be a self-suctioning injector inducing fluid by suction into the nozzle.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
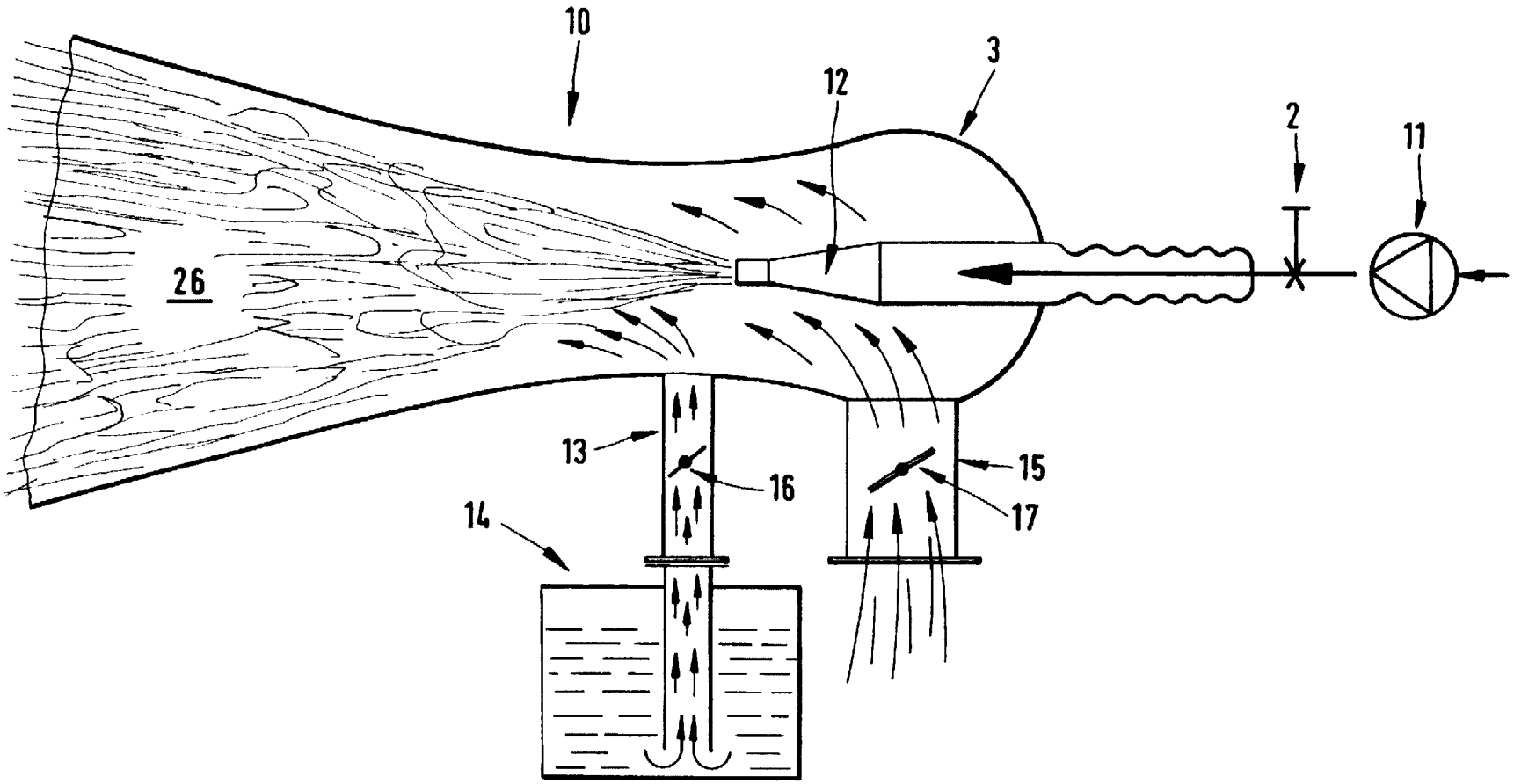
FIG. 1 is a diagrammatic side elevational view of a unit for generating an energy-rich aerosol stream in accordance with the invention.

FIG. 1 shows a unit 10 for generating an energy-rich aerosol stream 26 which comprises an accelerating nozzle 12 which discharges into a constriction with a Laval-type diffuser immediately upstream of the most constricted portion of the Laval nozzle. The accelerating nozzle 12 is in turn connected to a compressed-air source such as a compressor 11 and at the construction a fitting 12 opens to allow the introduction of a liquid from a liquid-supply unit 14 here represented as a tank.

Upstream of the accelerating nozzle 12 is a throttle valve 2 for control of the compressed-air flow rate.

The unit 10 has a housing 3 with also has a fitting 15 open to the ambient atmosphere to allow air to be sucked into the nozzle by the injector effect. In the fitting 13 there is provided a butterfly 16 while in the fitting 15 a butterfly 17 is provided to control the rates of flow through the fitting 13 and the fitting 15 and, together with the throttle 2, vary the proportion of liquid and air forming the aerosol in the reduced pressure zone upstream of the constriction. Both liquid and air are here sucked into the venturi-type device, intensively mixed and the liquid (preferably including anti-corrosion additives) dispersed to form the homogeneous aerosol 26.

Figure 2:
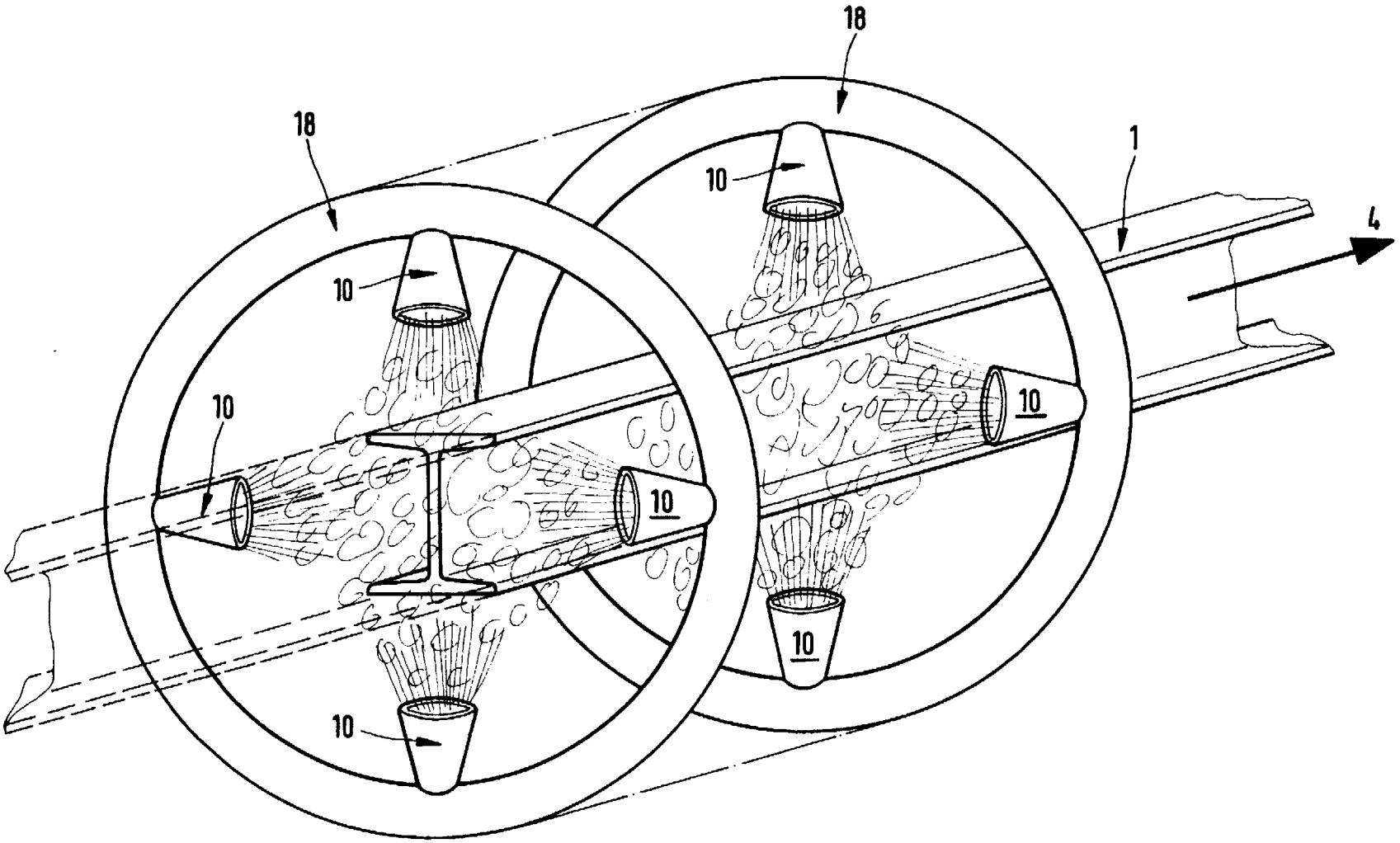
FIG. 2 is a diagrammatic perspective view showing the cooling of a structural shape such as an I beam by passing it through sets of nozzles disposed in two planes perpendicular to the direction of displacement of the I beam.

From FIG. 2 it will be apparent that a number of such nozzles can be provided at 10 in spaced relationship around the hot-rolled structural shape 1 and spaced apart in the direction of displacement thereof. In this embodiment, the units are provided in a pair of planes perpendicular to the structural shape 1 and the direction 4 of the displacement thereof and in holders 18. The units 10 with their respective housings 3 are mounted in or on the holder and are trained toward the axis of the profile, i.e. radially thereagainst, at angularly-equispaced locations. Since two such holders are provided, the aerosols are directed from around the structural shape thereagainst and at spaced locations along the profile thereagainst.

Figure 3:
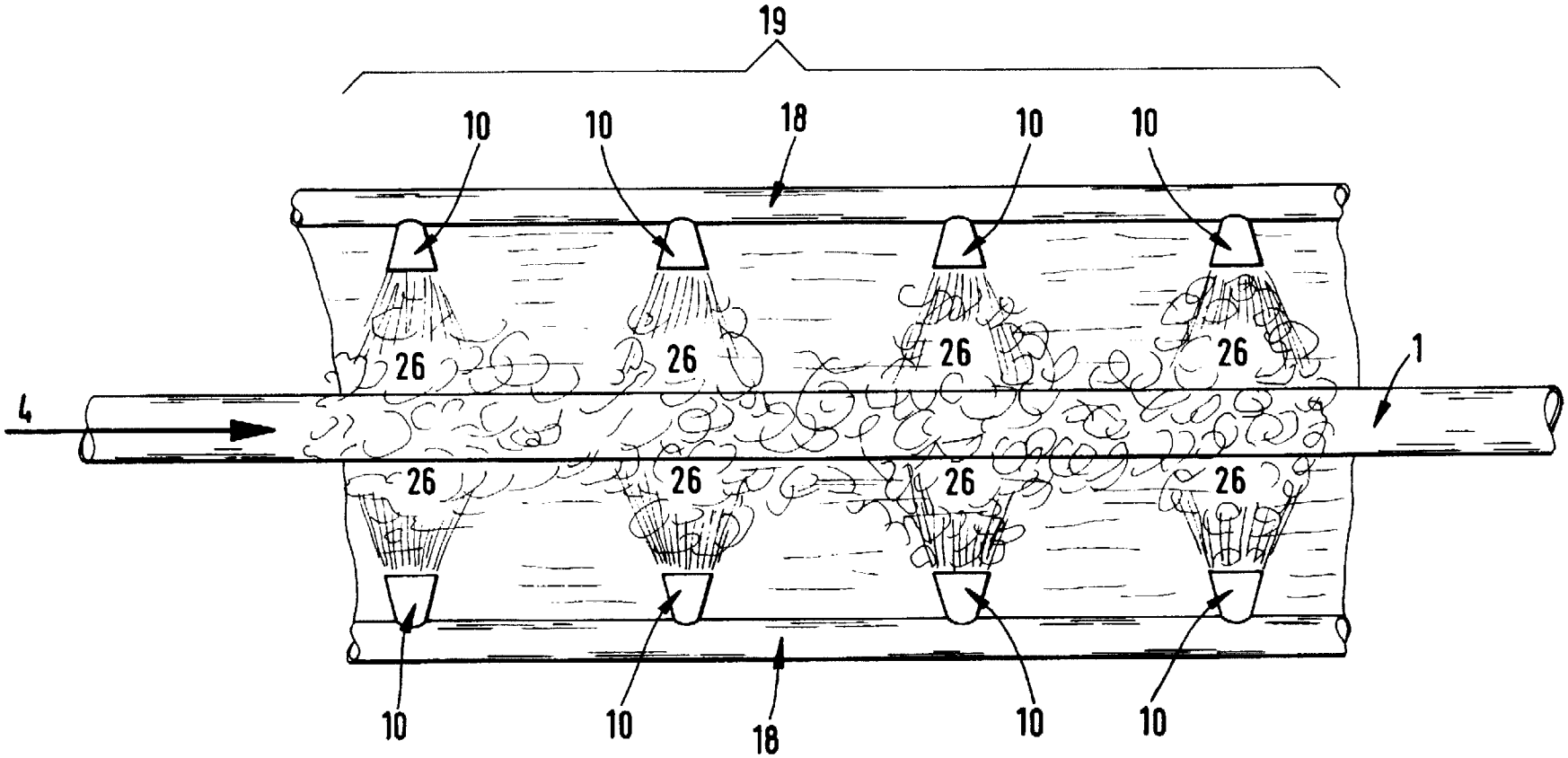
FIG. 3 is an elevational view showing another apparatus for cooling a structural shape in accordance with the present invention.

FIG. 3 shows a system in which a multiplicity of the units 10 are mounted on each of two holders 18*a* extending in the direction of displacement of the structural shape 1 to blow the aerosols against the structural shape at spaced locations therealong.

Figure 4:
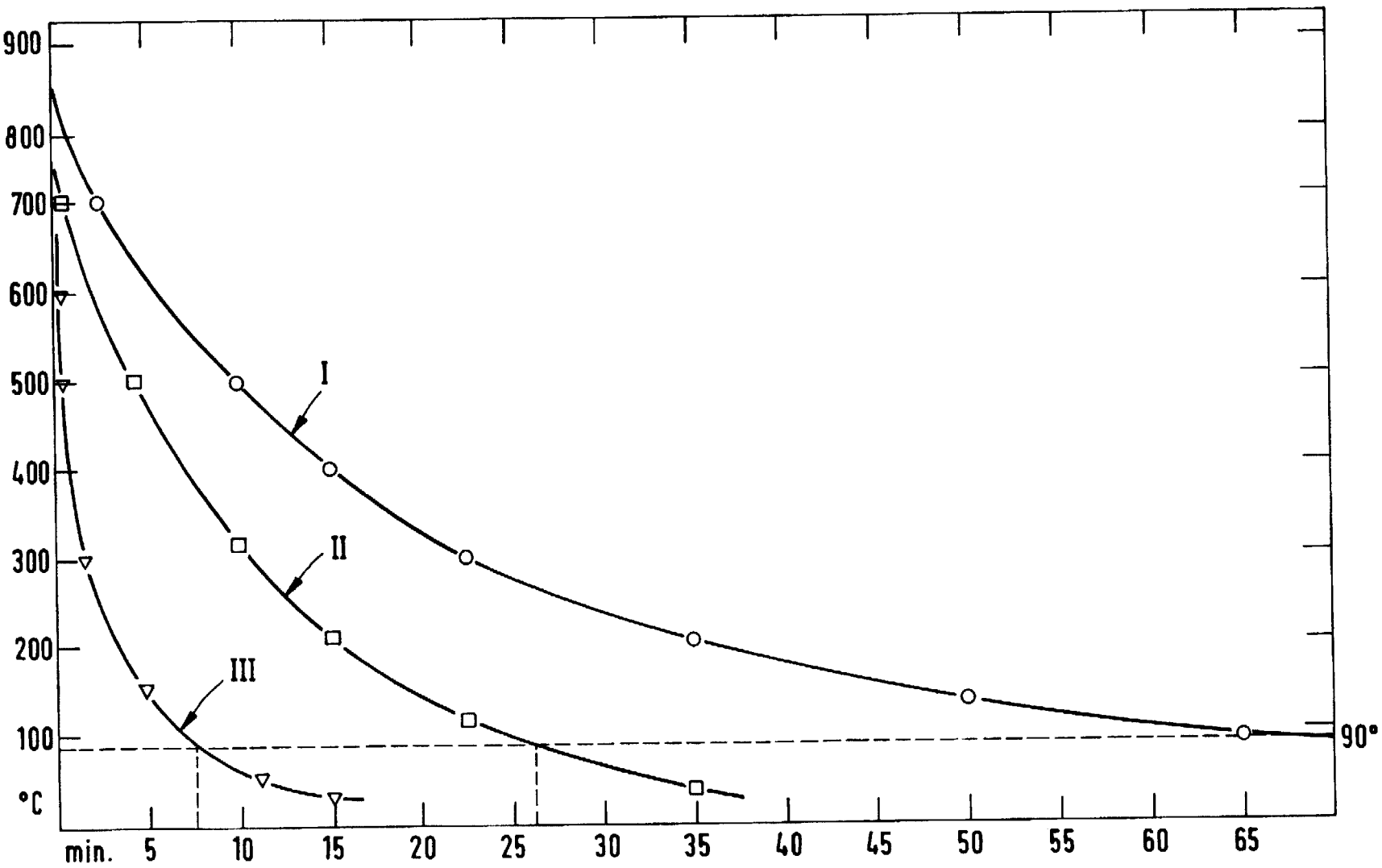
FIG. 4 is a graph in which the cooling of structural shapes is diagrammed, plotting the temperature of the structural shape along the ordinate versus time along the abscissa for different cooling systems and the same initial temperature and rolled product.

FIG. 4 shows three curves I, II and III representing the cooling of the same hot-rolled structural shape from a temperature of 900° C. under three different conditions. The uppermost curve shows the cooling characteristic from 900° C. to 90° C. over approximately 70 minutes in air which is not forcibly displaced and is dry. The intermediate curve II shows the cooling in about 26 minutes from 900° C. to 90° C. In curve III using the aerosol of the invention, a corresponding cooling is carried out in 7.5 minutes. With the water/air aerosol as the cooling medium, therefore, there is a significant improvement in the cooling rate of hot-rolled products.

The invention is not, however, limited to the embodiments shown and indeed other types of aerosol generators can be used. Both the liquid and the air can be forcibly displaced and volumetrically metered into an atomizing unit. The arrangement of the cooling nozzles and their orientation with respect to the structural shape can be modified as needs may dictate.

The invention is simple, effective and, by reducing the time and energy required to cool the structural shape, provides a substantial economic saving as well as reduced capital cost.

I claim:

1. An apparatus for cooling a hot-rolled structural shape, comprising:

means for supporting a hot rolled structural shape to be cooled;

a flow-accelerating venturi nozzle having an upstream end, a constriction and a diverging downstream end trained on said hot rolled structural shape for discharging fine droplets of water in an aerosol for cooling said structural shape with said aerosol;

a compressed air source connected to said nozzle and provided with a flow-accelerating jet opening into said nozzle at said constriction;

means for connecting said nozzle to a source of water at a location in said nozzle whereby said nozzle sucks water from said water source into said jet for dispersal of said water as said droplets in air traversing said nozzle from said upstream end to said downstream end;

a throttle valve connected between said jet and said compressed air source; and means for varying in the aerosol emerging from said downstream end proportions of air and water in said aerosol.

2. The apparatus defined in claim 1 wherein said nozzle widens continuously from a connection of said water source to said nozzle to said downstream end.

3. The apparatus defined in claim 1 wherein a plurality of said nozzles is provided on a common holder around an axis along which said structural shape extends.

4. The apparatus defined in claim 3 wherein said structural shape is displaceable along said axis and a plurality of holders are provided in succession along said axis in a direction of displacement of the structural shape, each with a plurality of said nozzles.

5. The apparatus as defined in claim 1 further comprising a holder concentrically surrounding said structural shape and formed with a plurality of said nozzles in an angularly equispaced relationship on said holder.

* * * * *